US005884121A

United States Patent [19]

Kyung

[11] Patent Number: 5,884,121

[45] Date of Patent: Mar. 16, 1999

[54] TRANSFER BIAS CONTROL METHOD FOR IMAGE FORMING APPARATUS USING ELECTROPHOTOGRAPHIC PROCESS

[75] Inventor: Myung-Ho Kyung, Suwon-shi, Rep. of Korea

[73] Assignee: SamSung Electronics Co., Ltd., Suwon, Rep. of Korea

[21] Appl. No.: 42,015

[22] Filed: Mar. 13, 1998

[30] Foreign Application Priority Data

Mar. 14, 1997 [KR] Rep. of Korea ..... 1997-8619

[51] Int. Cl.[6] ..... G03G 15/14

[52] U.S. Cl. ..... 399/66; 399/313; 399/314

[58] Field of Search ..... 399/66, 313, 314, 399/316, 315, 398

[56] References Cited

U.S. PATENT DOCUMENTS

| | | | |
|---|---|---|---|
| 4,839,695 | 6/1989 | Yamamoto et al. . | |
| 5,006,902 | 4/1991 | Araya . | |
| 5,012,293 | 4/1991 | Aldrich . | |
| 5,072,258 | 12/1991 | Harada . | |
| 5,164,779 | 11/1992 | Araya et al. . | |
| 5,253,022 | 10/1993 | Takeuchi et al. . | |
| 5,287,149 | 2/1994 | Hoshika . | |
| 5,410,393 | 4/1995 | Watanabe . | |
| 5,450,180 | 9/1995 | Ohzeki et al. . | |
| 5,479,243 | 12/1995 | Kurokawa et al. . | |
| 5,512,982 | 4/1996 | Takahashi et al. . | |
| 5,517,289 | 5/1996 | Ito et al. . | |
| 5,534,982 | 7/1996 | Sakaizawa et al. . | |
| 5,557,375 | 9/1996 | Nagayasu et al. . | |
| 5,568,232 | 10/1996 | Kashihara . | |
| 5,598,256 | 1/1997 | Kimura et al. | 399/316 |
| 5,713,063 | 1/1998 | Oono | 399/66 |
| 5,715,499 | 2/1998 | Yamazaki et al. . | |
| 5,717,981 | 2/1998 | Yamanaka | 399/101 |
| 5,724,636 | 3/1998 | Tombs et al. | 399/313 |
| 5,729,788 | 3/1998 | Hirohashi et al. | 399/66 |

*Primary Examiner*—Richard Moses
*Attorney, Agent, or Firm*—Robert E. Bushnell, Esq.

[57] ABSTRACT

A method for controlling a transfer bias in an image forming apparatus using an electrophotographic process to prevent front and rear ends of a paper from being contaminated by inversely charged toner. The image forming apparatus applies a second positive bias voltage having the intermediate level between a transfer voltage and a first positive bias voltage for cleaning the inversely charged toner with respect to the front and rear ends of the paper. In this manner, it is possible to prevent an electric shock on the photosensitive drum due to an abrupt voltage difference between the transfer voltage and the first positive bias voltage.

8 Claims, 5 Drawing Sheets

TRANSFER BIAS CONTROL METHOD FOR IMAGE FORMING APPARATUS USING ELECTROPHOTOGRAPHIC PROCESS

CLAIM FOR PRIORITY

This application makes reference to, incorporates the same herein, and claims all benefits accruing under 35 U.S.C. §119 from an application for TRANSFER BIAS CONTROL METHOD FOR IMAGE FORMING APPARATUS EMPLOYING ELECTROPHOTOGRAPHIC PROCESS earlier filed in the Korean Industrial Property Office on the $14^{th}$ of Mar. 1997, and there duly assigned Ser. No. 8619/1997, a copy of which application is annexed hereto.

BACKGROUND OF THE INVENTION

1. Technical Field

The present invention relates to an image forming apparatus using an electrophotographic process, and in particular, to a method for controlling a transfer bias of a transfer roller which transfers toner image from a photosensitive drum to a paper.

2. Related Art

An electrophotographic process is widely employed for an image forming apparatus such as a copier, a laser beam printer (LBP), a facsimile machine, etc. The electrophotographic process commonly consists of the successive steps of charging→exposing→developing→transferring→fixing. First, a photosensitive drum is uniformly charged to a predetermined potential, and the charged portion of the photosensitive drum is exposed to a light image of an original document being reproduced. This creates an electrostatic latent image corresponding to the document image on the photosensitive drum. After the electrostatic latent image is formed on the photosensitive drum, the latent image is developed by applying toner particles from a developing unit into contact with the latent image formed on the photosensitive drum. This forms a toner image of the original document on the photosensitive drum which is subsequently transferred and fixed on a recording medium. When a toner image is fixed on a recording medium, the toner image is first heated and fused onto the recording medium, and then naturally cooled so that it is fixed onto the recording medium.

Generally, as a unit for charging the surface of the photosensitive drum, a contact-type charging roller is used to produce an uniform electric field in response to application of high voltage for charging the surface of the photosensitive drum to a constant potential to attract toner particles and thereby form the latent image on the photosensitive drum. Typically, a charging unit is charged at the start of a printing operation. The surface of the photosensitive drum is charged and a developing unit is concurrently charged by way of the charging unit as the photosensitive drum rotates in a direction opposite to the rotation of the developing unit. As a result, an electrostatic latent image is formed on the photosensitive drum and the latent image is then visualized as a toner image by the developing unit. The charged area of the photosensitive drum is then exposed to a laser beam. Because of the potential difference between the exposed area and the unexposed area of the photosensitive drum, the toner particles are attracted only to the exposed area to form the toner image on the photosensitive drum. The toner image is then transferred to the recording medium. After the toner image is transferred to the recording medium, the photosensitive drum is charged back to an original voltage as the recording medium is being conveyed to a fixing unit. A common problem to contemporary charging unit, as I have observed, is that toner supplied from the developing unit often sticks on an unexposed area so that both edges of the recording medium can be contaminated.

Conventionally, there are a number of known techniques for controlling the charge and surface potential of a photosensitive drum to form an electrostatic latent image thereon as described, for example, in U.S. Pat. No. 4,839,695 for Device For Controlling Charge Area Of Photoreceptor issued to Yamamoto et al., U.S. Pat. No. 5,072,258 for Method Of Controlling Surface Potential Of Photoconductive Element issued to Harada, U.S. Pat. No. 5,164,779 for Image Forming Apparatus With Dual Voltage Supplies For Selectively Charging And Discharging An Image Bearing Member issued to Araya et al., U.S. Pat. No. 5,247,328 for Method And Apparatus For Charging A Photoconductive Surface To A Uniform Potential issued to Daunton et al., U.S. Pat. No. 5,287,149 for Image Forming Apparatus Having Image Transfer Electrode Contactable To Transfer Material issued to Hoshika, U.S. Pat. No. 5,450,180 for Image Forming Apparatus Having Constant Current And Voltage Control In The Charging And Transfer Regions issued to Ohzeki et al., U.S. Pat. No. 5,479,243 for Image Forming Apparatus And Charging Device Thereof issued to Kurokawa, U.S. Pat. No. 5,512,982 for Image Forming Apparatus With A Photosensitive Member And A Charging Device Having An Oscillatory Voltage Source issued to Takahashi et al., U.S. Pat. No. 5,517,289 for Apparatus for And Method Of Forming Image issued to Ito et al., U.S. Pat. No. 5,534,982 for Developing Apparatus issued to Sakaizawa et al., U.S. Pat. No. 5,557,375 for Contact Type Charging Device And Image Forming Apparatus Having The Same issued to Nagayasu et al., and U.S. Pat. No. 5,715,499 for Contact Charger Having Oscillating Voltage For Charging A Photosensitive Member issued to Yamazaki. While these conventional charging techniques contain their own merits, I have noted that none can efficiently minimize contamination of inversely charged toner from the photosensitive drum at front and rear ends of the paper due to the abrupt bias voltage difference. Hence, the front and rear ends of the paper may be contaminated more severely than other places of the paper.

SUMMARY OF THE INVENTION

Accordingly, it is therefore an object of the present invention to provide an improved image forming apparatus and process.

It is also an object to provide a transfer bias control circuit for an image forming apparatus and method for preventing the front and rear ends of a paper from being contaminated by an inversely charged toner.

These and other objects of the present invention can be achieved by a method for controlling a transfer bias in an image forming apparatus using an electrophotographic process for transferring negatively charged toner attached onto a photosensitive drum to a paper by applying a transfer voltage of a positive bias to a transfer roller. The method comprises the steps of applying a first positive bias voltage being lower than the transfer voltage to the transfer roller before and after a transfer interval where the negatively charged toner is transferred to the paper, so as to transfer the inversely charged toner attached onto the transfer roller to the photosensitive drum; and applying to the transfer roller a second positive bias voltage having a level between the transfer voltage and the first positive bias voltage for a first duration around a time point where a front end of the paper reaches a contact between the photosensitive drum and the transfer roller and for a second duration around a time point where a rear end of the paper gets out of the contact between the photosensitive drum and the transfer roller.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
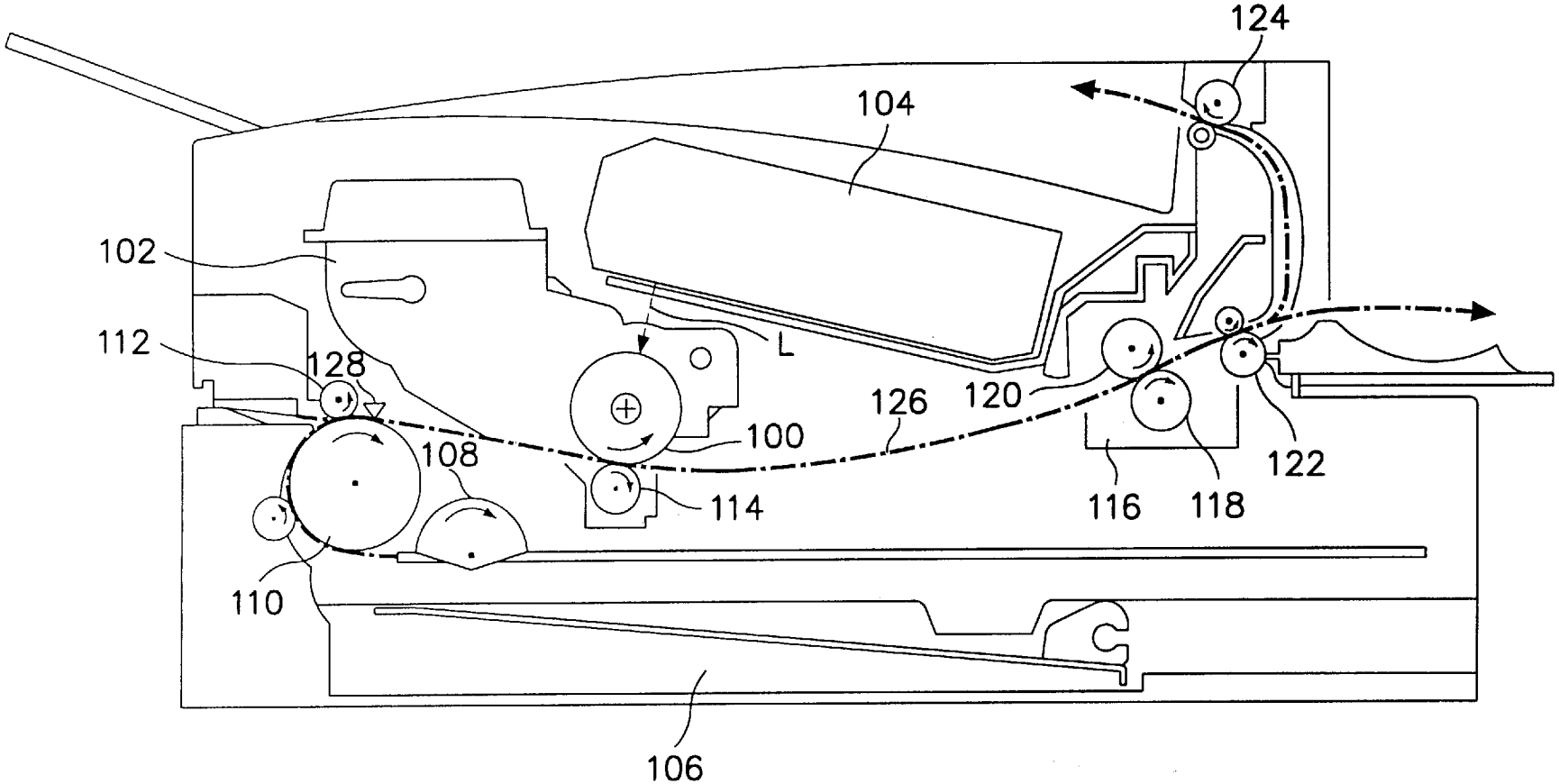
FIG. 1 is an abstract representation illustrating placement of salient components in a general image forming apparatus using an electrophotographic process.

Referring now to the drawings and particularly to FIG. 1, which illustrates a general image forming apparatus such as a laser beam printer using an electrophotographic process. The image forming apparatus includes a photosensitive drum 100, a developing unit 102, a laser scanning unit 104, a paper cassette 106 for containing a stack of cut sheet paper, a pickup roller 108, a pair of feed rollers 110 for feeding the paper from an upstream side along a direction of transport 126 of a sheet of the paper, a register roller 112, a transfer roller 114, a fixing unit 116 containing a pressure roller 118 and a heat roller 120, a pair of discharge rollers 122, 124 and a discharge tray and the like so as to transport the paper separated from the photosensitive drum 100. A sensor 128 is positioned in proximity of the register roller 112 for paper registration purposes.

Figure 2:
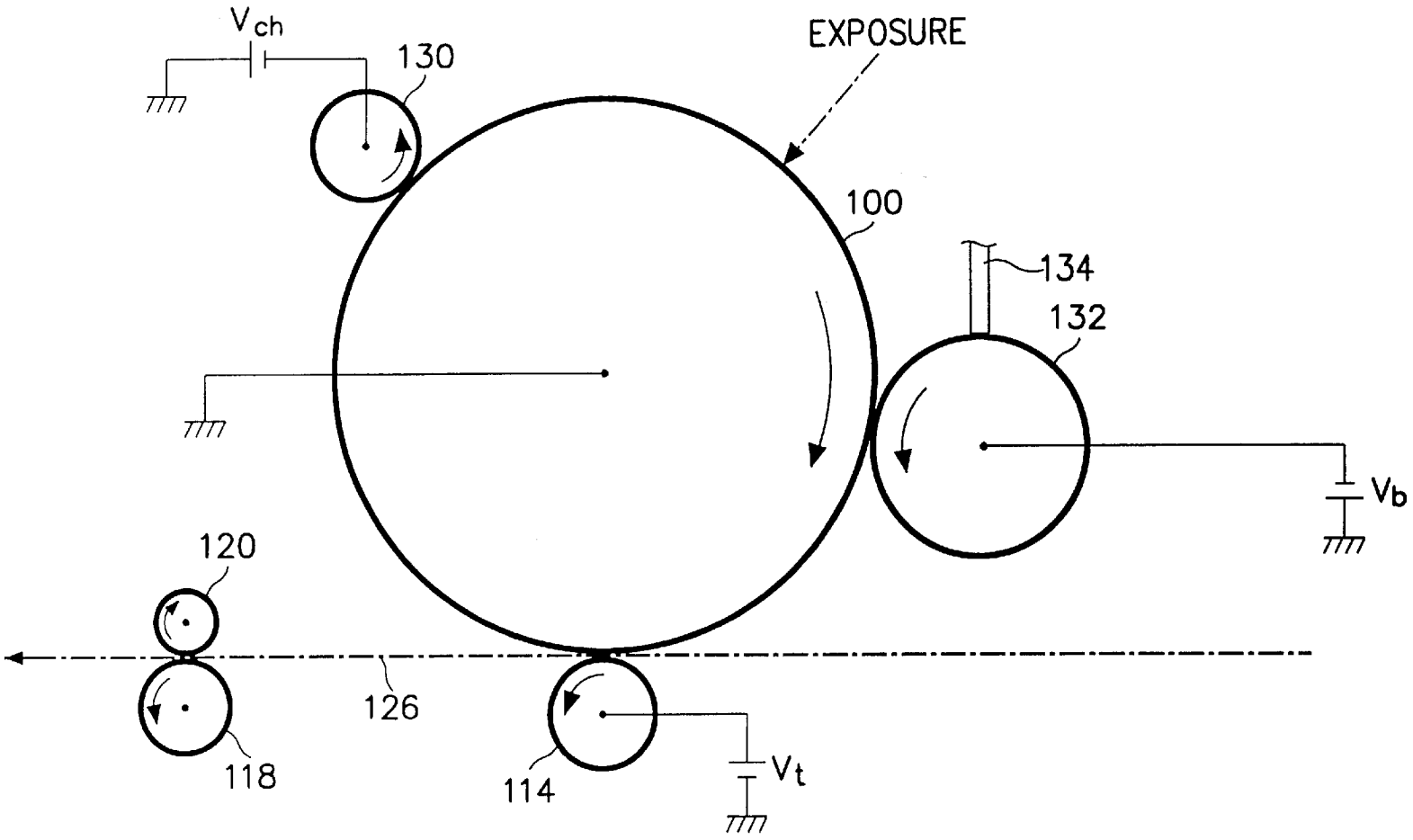
FIG. 2 is a diagram for illustrating a biasing state of respective components of FIG. 1.

As shown in FIG. 1, the photosensitive drum 100 and various other rollers rotate in the arrow directions in correspondence with the electrophotographic process. A paper sheet fed from the paper cassette 106 travels along a sheet transfer path 126 and is finally discharged from the image forming apparatus. As the process proceeds, the respective components of such image forming apparatus are biased as shown in FIG. 2. Throughout FIGS. 1 and 2, the like reference numerals denote the like elements. A charging roller 130, a developing roller 132 and a regulation blade 134 which are not denoted in FIG. 1 are mounted in the developing unit 102.

The photosensitive drum 100 is first charged with a charging voltage Vch, e.g., −1.4[KV], of a negative bias by means of the charging roller 130, so that a surface of the photosensitive drum 100 is uniformly charged with a negative electric potential of about −800[V]. As the photosensitive drum 100 rotates, its surface is exposed to the light irradiated from the laser scanning unit (LSU) 104, and a latent image is formed on the exposed surface. Here, a non-image area of the photosensitive drum 100, which is not exposed to the light, maintains the original electric potential, whereas the exposed image area has a low electric potential of several tens of negative voltages. With the rotation of the photosensitive drum 100, the surface of the photosensitive drum 100, on which an electrostatic latent image is formed, reaches a developing position to form an electrostatic latent image in response to the negatively charged toner on the developing roller 132. This toner image is subsequently converted into a visible image. The developing roller 132 has a negative electric potential, for example, of −250[V] ~−350[V] by a developing voltage Vb of a negative bias. Therefore, the toner particles on the developing drum 132 move to the exposed image area of the photosensitive drum 100, by means of the electrostatic force caused by the potential difference between the exposing potential and the developing potential.

Under this condition, the paper sheet fed from the paper cassette 106 by the pickup roller 108, the front end of which is aligned by a register roller 112, is conveyed toward a transfer roller 114. As the sensor 128 mounted at an immediately following stage of the register 112 senses the front end of the paper being fed from the paper cassette 106, the exposing process begins. Successively, the transferring process begins, when the front end of the paper sheet reaches a contact between the photosensitive drum 100 and the transfer roller 114.

After the exposing and developing processes, the photosensitive drum 100 continuously rotates to reach a transfer position so as to begin the transferring process. In the transferring process, transfer roller 114 is provided with a positive bias between hundreds KV and thousands KV. Then, the toner particles attached to the photosensitive drum 100 by the electrostatic force caused by the potential difference between the transfer roller 114 and the photosensitive drum 100 are transferred to the paper sheet. The toner particles transferred onto the paper are fixed on the paper by the pressure and heat of the fixing unit 116. After completion of the fixing process, the paper sheet is discharged from the laser beam printer. The above processes circulates continuously until printing for the paper sheet is completed.

Although most of the toner particles attached onto the photosensitive drum 100 are transferred to the paper during the above electrophotographic process, some of the toner particles remain on the photosensitive drum 100. Furthermore, occasionally, some of the toner particles covering the developing roller 132 may scatter to attach onto the photosensitive drum 100 or the transfer roller 114. In case such non-transferred and scattered toner particles are attached to the transfer roller 114, they may be transferred onto the back of the paper sheet or onto the surface of the photosensitive drum 100 in the next transferring process, thereby contaminating the image on the paper. In this situation, the toner particles contaminating the transfer roller 114 consists of the inversely charged toner having a positive potential as well as the negatively charged toner having a negative potential. The negatively charged toner represents the toner which are normally frictionally charged at the developing roller 132 by the negative potential, whereas the inversely charged toner represents the toner being abnormally frictionally charged at the developing roller 132 or being charged at the transfer roller 114 by the positive transfer voltage Vt.

Figure 3:
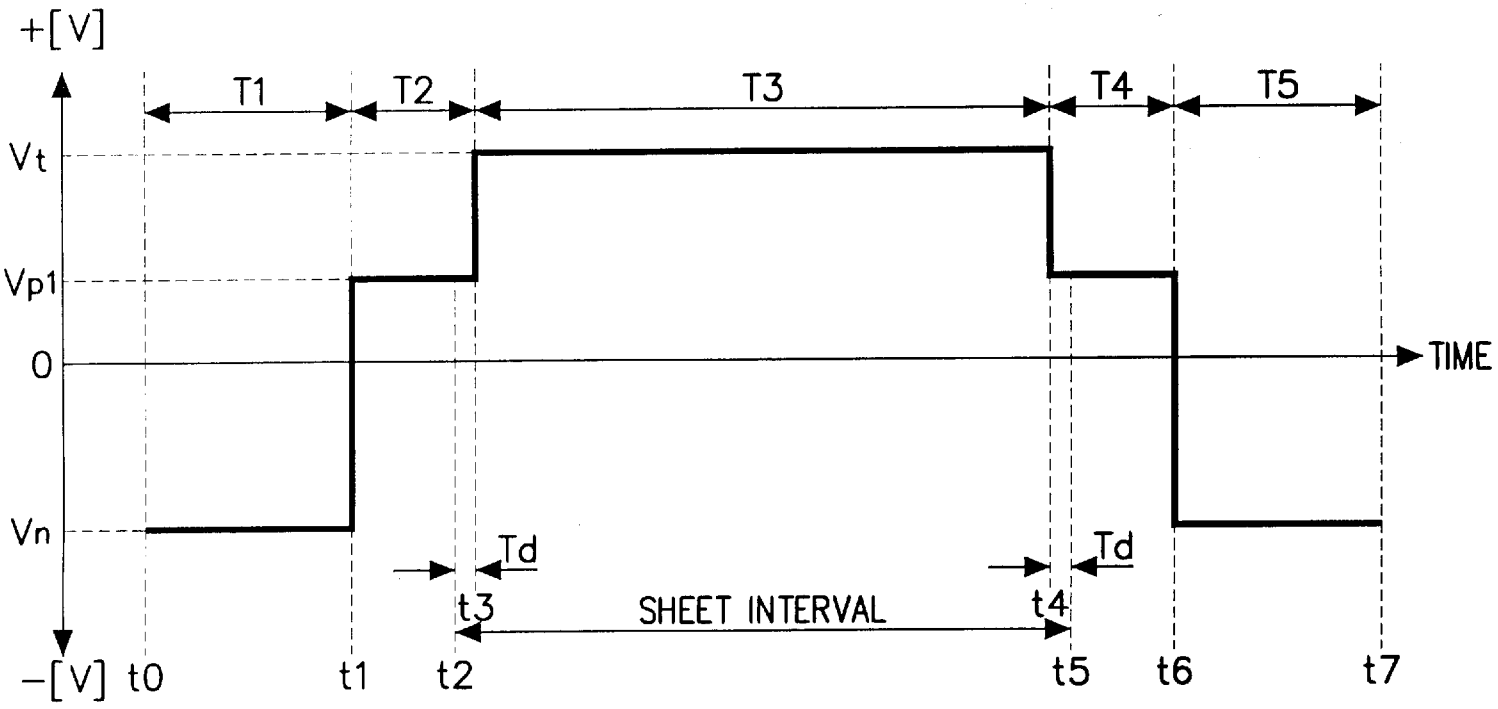
FIG. 3 is a control timing diagram of a transfer bias according to the general image forming apparatus.

In order to clean the toner particles attached to the transfer roller 114, the transfer bias of the transfer roller 114 was conventionally controlled according to the control timing as shown in FIG. 3. As illustrated in FIG. 3, at a first interval T1 from time t0 to time t1 where a printing operation for a sheet of the paper is performed, a negative bias voltage Vn is applied to the transfer roller 114. Accordingly, the negatively charged toner contaminating the transfer roller 114 is attached to the photosensitive drum 100, thereby cleaning the transfer roller 114. Further, at a second interval T2 from time t1 to time t3, a positive bias voltage Vp1 is applied to the transfer roller 114. Hence, the inversely charged toner contaminating the transfer roller 114 is attached to the photosensitive drum 100, thereby cleaning the transfer roller 114. Next, at a third interval T3 from time t3 to time t4, the transfer voltage Vt of the positive bias is applied to the transfer roller 114 so as to actually transfer the negatively charged toner image on the photosensitive drum 100 to the paper. The transfer voltage Vt is properly set so as to optimally transfer the toner image to the paper.

Thereafter, at a fourth interval T4 from time t4 to time t6, the same bias voltage as that in the second interval T2 is applied to the transfer roller 114 so as to clean the inversely charged toner. Next, at a fifth interval T5 from time t6 to time t7, the same bias voltage as that in the first interval T1 is applied to the transfer roller 114 so as to clean the negatively charged toner. Herein, the second and fourth intervals T2 and T4 are intervals for preventing the transfer roller 114 from being contaminated by drifting toner and further, preventing the back of the paper from being contaminated by the toner attached onto the transfer roller 114 during the actual transfer process.

Moreover, in order to prevent an electric shock on the photosensitive drum 100 due to the transfer voltage difference according to existence/non-existence of the paper between the photosensitive drum 100 and the transfer roller 114, the timing for applying the transfer voltage Vt to the transfer roller 114 falls behind and precedes the beginning and end of a paper interval by time Td at the front and rear ends of the paper, respectively, as shown in FIG. 3. Namely, the transfer voltage Vt is applied to the transfer roller 114 beginning at the time t3 which falls behind the time t2 by time Td, at which the front end of the paper is expected to reach the contact between the photosensitive drum 100 and the transfer roller 114. Furthermore, the transfer voltage Vt being applied to the transfer roller 114 is changed to the positive bias voltage Vp1 at the time t4 which precedes the time t5 by the time Td, at which the rear end of the paper is expected to get out of the contact between the photosensitive drum 100 and the transfer roller 114.

The reason that the timing of applying the transfer voltage Vt falls behind and precedes the beginning and end of the paper interval at the front and rear ends of the paper respectively, is because it is difficult to realize a control system for accurately controlling the timing for applying the transfer voltage Vt at the front and rear ends of the paper. If the transfer voltage Vt is applied to the transfer roller 114 before and after the paper reaches and gets out of the photosensitive drum 100, the photosensitive drum 100 may received an electric shock, thereby causing smears on the image. Furthermore, the positive bias voltage Vp1 applied at the second and fourth intervals T2 and T4 is set to a minimum permissible voltage for preventing the electric shock on the photosensitive drum 100 in order to prevent contamination on the back of the paper and contamination of the transfer roller 114.

However, in case the non-image area on the photosensitive drum 100 is contaminated by the inversely charged toner on the developing roller 132, the inversely charged toner on the photosensitive drum 100 may be attached to the paper at front and rear ends of the paper due to the abrupt bias voltage difference between the second and third intervals T2 and T3, and between the third and fourth intervals T3 and T4. Hence, the front and rear ends of the paper may be contaminated more severely than other places of the paper.

Figure 4:
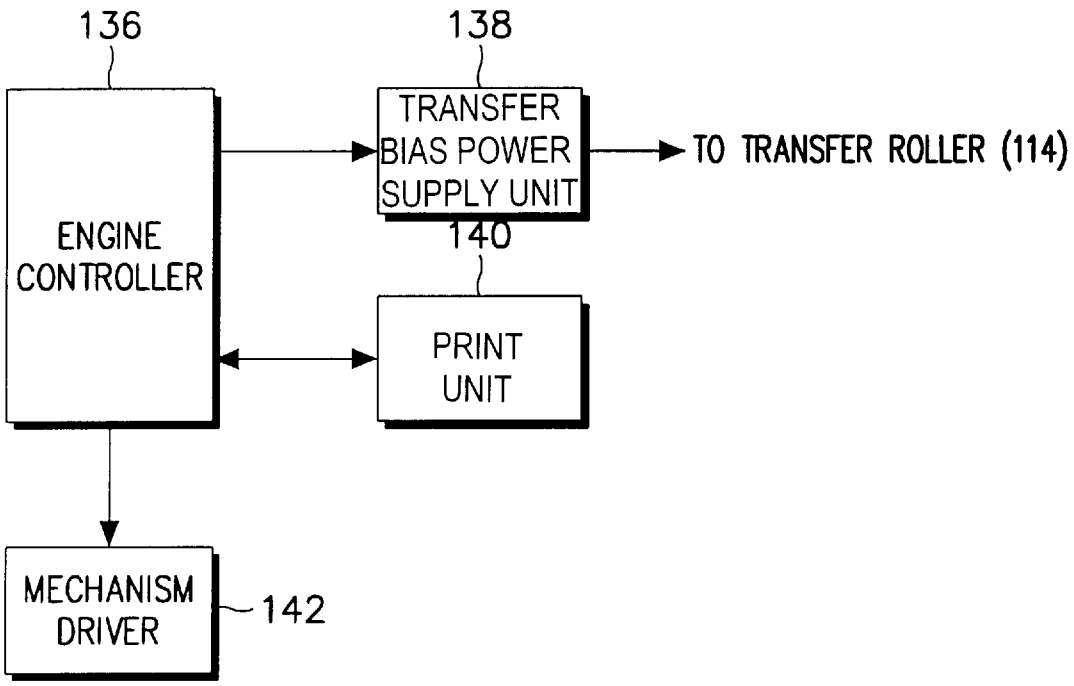
FIG. 4 is a block diagram of a transfer bias control circuit of an image forming apparatus constructed according to the principles of the present invention.

Turning now to FIG. 4, which illustrates a transfer bias control circuit of an image forming apparatus constructed according to the principles of the present invention. The transfer bias control circuit includes an engine controller 136, a transfer bias power supply unit 138, a print unit 140 and a mechanism driver 142. The engine controller 136 controls an overall operation of the image forming apparatus as shown in FIG. 1, including the print unit 140 and the mechanism driver 142 so as to perform a printing operation using an electrophotographic process. Moreover, the engine controller 136 controls the transfer bias power supply unit 138 to provide the transfer voltage Vt and a bias voltage for cleaning the inversely charged toner and the negatively charged toner contaminating the transfer roller 114.

Figure 5:
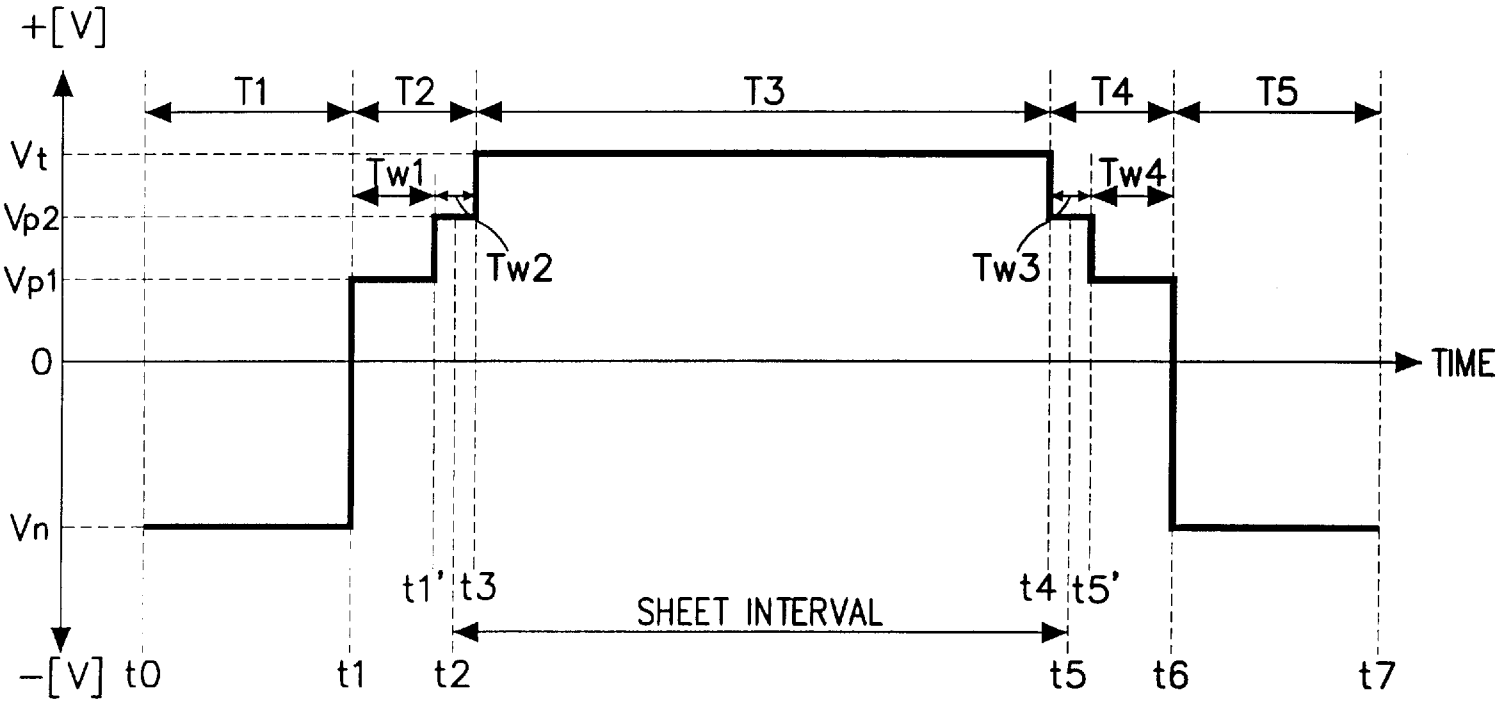
FIG. 5 is a control timing diagram of a transfer bias according to a preferred embodiment of the present invention.

FIG. 5 illustrates a timing diagram for controlling the transfer bias by means of the engine controller 136 according to an embodiment of the present invention. Referring to FIG. 5, a second positive bias voltage Vp2 which is lower than the transfer voltage Vt but is higher than a first positive bias voltage Vp1 is applied before and after the front and rear ends of the paper.

First, the engine controller 136 controls the transfer bias power supply unit 138 to apply the negative bias voltage Vn to the transfer roller 114 at the first interval T1 from the time t0 to the time t1 in the same way as in FIG. 3, so as to clean the negatively charged toner attached onto the transfer roller 114. Then, the engine controller 136 applies the first positive bias voltage Vp1 to the transfer roller 114 for a preceding duration Tw1 of the second interval T2, lasting from the time t1 to time t1', so as to prevent the back of the paper from being contaminated. In this situation, the first positive bias voltage Vp1 is the maximum permissible voltage which is not sufficient to generate the electric shock to the photosensitive drum 100.

Next, the engine controller 136 applies the second positive bias voltage Vp2 to the transfer roller 114 for the following duration Tw2 of the second interval T2, before the transfer voltage Vt is applied to the transfer roller 114. That is, the second positive bias voltage Vp2 is applied to the transfer roller 114 for the duration Tw2 from the time t1' to the time t3, wherein the time t1' precedes the time t2 at which the front end of the paper reaches the contact between the photosensitive drum 100 and the transfer roller 114. The second positive bias voltage Vp2 is set higher than the first positive bias voltage Vp1. For example, the second positive bias voltage Vp2 is set to an intermediate level between the transfer voltage Vt and the first positive bias voltage Vp1.

Accordingly, by applying the second positive bias voltage Vp2 having the intermediate level between the transfer voltage Vt and the first positive bias voltage Vp1 to the transfer roller 114 with respect to the front end of the paper, the abrupt change of the bias voltage between the second interval T2 and the third interval T3 can be prevented. Thus, the contamination at the front end of the paper due to the inversely charged toner on the photosensitive drum 100 may be prevented.

Thereafter, the transfer voltage Vt is applied to the transfer roller 114 for the third interval T3 between the time t3 and the time t4, in the same manner as described with reference to FIG. 3. Then, the engine controller 136 applies the second positive bias voltage Vp2 to the transfer roller 114 for a preceding duration Tw3 of the fourth interval T4 from the time t4 to time t5', wherein the time t4 precedes the time t5 at which the rear end of the paper gets out of the contact between the photosensitive drum 100 and the transfer roller 114. Successively, the engine controller 136 applies the first positive bias voltage Vp1 to the transfer roller 114 for a following duration Tw4 of the fourth interval T4, lasting from the time t5' to the time t6.

By applying the second positive bias voltage Vp2 having the intermediate level between the transfer voltage Vt and the first positive bias voltage Vp1 to the transfer roller 114 with respect to the rear end of the paper, the abrupt change of the bias voltage between the third interval T3 and the fourth interval T4 can be prevented. Thus, the contamination at the rear end of the paper due to the inversely charged toner on the photosensitive drum 100 may be prevented.

Finally, the engine controller 136 applies the negative bias voltage Vn to the transfer roller 114 for the fifth interval T5 from the time t6 to the time t7 in the conventional manner, so as to clean the inversely charged toner on the transfer roller 114. Preferably, the durations Tw1 and Tw2 are set equal to the durations Tw3 and Tw4, respectively.

As descried above, the laser beam printer according to the present invention can prevent the contamination due to the inversely charged toner, by applying the second positive bias voltage Vp2 having the intermediate level between the transfer voltage Vt and the first positive bias voltage Vp1 for cleaning the inversely charged toner with respect to the front and rear ends of the paper.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A method for controlling a transfer bias in an image forming apparatus using an electrophotographic process for transferring negatively charged toner from a photosensitive drum to a printable medium for image formation by applying a transfer voltage of a positive bias to a transfer roller, said method comprising the steps of:

applying to said transfer roller, a first positive bias voltage lower than said transfer voltage before and after a transfer interval where said negatively charged toner is transferred to the printable medium, so as to transfer the inversely charged toner from said transfer roller to said photosensitive drum; and applying to said transfer roller, a second positive bias voltage higher than said first positive bias voltage but lower than said transfer voltage for a first duration where a front end of the printable medium reaches a contact point between the photosensitive drum and the transfer roller and for a second duration where a rear end of the printable medium separates from the contact point between the photosensitive drum and the transfer roller.

2. The method of claim 1, further comprised of said second positive bias voltage corresponding to an intermediate level between said transfer voltage and said first positive bias voltage for preventing the front and rear ends of the printable medium from contamination of inversely charged toner.

3. A method for controlling a transfer bias in an image forming apparatus using an electrophotographic process for transferring negatively charged toner attached onto a photosensitive drum to a printable medium by applying a transfer voltage of a positive bias to a transfer roller, said method comprising the steps of:

applying to said transfer roller, a negative bias voltage of a specified level for a first interval before a front end of the printable medium reaches a contact point between said photosensitive drum and said transfer roller, starting from a feed of the printable medium;

applying to said transfer roller, a first positive bias voltage lower than said transfer voltage for a preceding duration of a second interval lasting from an end of said first interval to a time point where the negatively charged toner begins to be transferred to the printable medium, before the front end of the paper reaches said contact point between said photosensitive drum and said transfer roller;

applying to said transfer roller, a second positive bias voltage higher than said first positive bias voltage but lower than said transfer voltage for a following duration of said second interval, said following duration lasting from the end of said preceding duration to a time point where a predetermined time has elapsed after the front end of the paper has reached said contact point between said photosensitive drum and said transfer roller;

applying to said transfer roller, said transfer voltage for a third interval from the end of said second interval to a time point where the negatively charged toner is completely transferred to the printable medium;

applying to said transfer roller, said second positive bias voltage for a preceding duration of a fourth interval from an end of said third interval to a time point where a predetermined time has elapsed after a rear end of said printable medium separates from the contact point between said photosensitive drum and said transfer roller;

applying to said transfer roller, said first positive bias voltage for a following duration of said fourth interval; and applying to said transfer roller, said negative bias voltage for a fifth interval from the end of said fourth interval until a printing process for said printable medium is completed.

4. The method of claim 3, further comprised of said second positive bias voltage corresponding to an intermediate level between said transfer voltage and said first positive bias voltage for preventing the front and rear ends of the printable medium from contamination of negatively charged toner.

5. An image forming apparatus, comprising:

a photosensitive drum;

a transfer roller for transferring negatively charged toner from the photosensitive drum to a printable medium during an image transfer interval; and a transfer bias controller for controlling a transfer bias of said transfer roller by:

applying to said transfer roller, a first positive bias voltage lower than a transfer voltage before and after the image transfer interval where said negatively charged toner is transferred to the printable medium, so as to transfer the inversely charged toner from said transfer roller to said photosensitive drum; and applying to said transfer roller, a second positive bias voltage higher than said first positive bias voltage but lower than said transfer voltage for a first duration where a front end of the printable medium reaches a contact point between the photosensitive drum and the transfer roller and for a second duration where a rear end of the printable medium separates from the contact point between the photosensitive drum and the transfer roller.

6. The image forming apparatus of claim 5, further comprised of said second positive bias voltage corresponding to an intermediate level between said transfer voltage and said first positive bias voltage for preventing the front and rear ends of the printable medium from contamination of inversely charged toner.

7. The image forming apparatus of claim 6, further comprising:

a charging unit for applying voltages differentially to the surface of said photosensitive drum during an image forming area where said photosensitive drum is in contact with said printable medium and during a non-image forming area where said photosensitive drum is not in contact with said printable medium to charge the surface of said photosensitive drum a light scanner unit for forming an electrostatic latent image on said photosensitive drum corresponding to image data; and a developing unit for applying toner onto said photosensitive drum while said photosensitive drum is in contact with said printable medium during said image forming area.

8. The image forming apparatus of claim 6, further comprised of said transfer bias controller applying to said transfer roller, said transfer voltage, said first positive bias voltage, and said second positive bias voltage from a power supply unit.

* * * * *